US005477559A

United States Patent [19]

Clement

[11] Patent Number: 5,477,559

[45] Date of Patent: Dec. 26, 1995

[54] EXTENSIBLE SHIN GUARD

[75] Inventor: Leonard W. Clement, Bolton, Canada

[73] Assignee: Irwin Toy Limited, Toronto, Canada

[21] Appl. No.: 166,063

[22] Filed: Dec. 14, 1993

[30] Foreign Application Priority Data

Jan. 20, 1993 [CA] Canada ..... 2087702-2

[51] Int. Cl.[6] ..... A41D 13/06

[52] U.S. Cl. ..... 2/22

[58] Field of Search ..... 2/22, 23, 24, 16, 2/62, 269; 602/16, 20, 23, 26

[56] References Cited

U.S. PATENT DOCUMENTS

| | | | |
|---|---|---|---|
| 2,325,321 | 7/1943 | Hubner et al. . | |
| 2,565,762 | 8/1951 | Ferguson | 2/22 |
| 2,982,968 | 5/1961 | Groot | 2/22 |
| 3,135,964 | 6/1964 | Pender . | |
| 3,735,419 | 5/1973 | Byrd . | |
| 3,761,960 | 10/1973 | Woodcock . | |
| 4,354,280 | 10/1982 | Hayes . | |
| 4,490,855 | 1/1985 | Figgie, III et al. . | |
| 4,599,748 | 7/1986 | Garcia . | |
| 4,751,748 | 6/1988 | Ekins . | |
| 4,888,826 | 12/1989 | Parsons, Jr. et al. | 2/22 |
| 4,999,847 | 3/1991 | Barcelo . | |

FOREIGN PATENT DOCUMENTS

| | | |
|---|---|---|
| 2084328 | 6/1994 | Canada . |
| 2084329 | 6/1994 | Canada . |

OTHER PUBLICATIONS

Journal of A.M.A., vol. 168, No. 7, Oct. 18, 1958.

*Primary Examiner*—Paul C. Lewis

*Attorney, Agent, or Firm*—Jeffrey Imai; Arne I. Fors; D. Doak Horne

[57] ABSTRACT

An extensible shin guard comprises a knee pad section and a shin protector section. A tongue member extends from the knee pad section and is adapted to extend along an interior surface of the shin protector section. The tongue has a fastener for releasably attaching the knee pad section to the shin protector section, spacing the knee pad section from the shin protector section at one of a plurality of positions for extending the shin guard. A joint pad extends from the knee pad section for overlying an area between the knee pad section and the shin protector section.

5 Claims, 3 Drawing Sheets

EXTENSIBLE SHIN GUARD

FIELD OF INVENTION

This invention relates to an extensible shin guard.

BACKGROUND OF INVENTION

Hockey is a sport which is played in North America and Europe. Shin guards are essential for protection and safe play, particularly for children.

There are numerous models and types of shin guards available to fit all sizes of players, including the shin guards described in the following U.S. patents:

| | |
|---|---|
| 2,325,321 | Hubner et al.; |
| 3,135,964 | Pender; |
| 3,735,419 | Byrd; |
| 3,761,960 | Woodcock; |
| 4,751,748 | Ekins; and |
| 4,999,847 | Barcelo. |

In each of the shin guards described in these patents, the knee pad is hinged or attached to the shin portion. The size of the shin guard is set by the manufacturer, normally by making the shin guard in small, medium and large sizes. The sizes cannot be varied by the wearer.

The models available for children are usually smaller versions of the adult sized models. Since a child will grow not only from year to year but during the hockey season, it becomes increasingly difficult and expensive to outfit a child for multiple seasons of hockey.

SUMMARY OF INVENTION

The disadvantages of the prior art may be overcome by providing a shin guard with a means for extending the size of the shin guard to properly fit a player from year to year.

According to one aspect of the invention there is provided an extensible shin guard comprising: a knee pad section, a shin protector section, attachment means for releasably attaching said knee pad section to said shin protector section, spacing the knee pad section from the shin protector section at one of a plurality of positions for extending said shin guard and a joint pad extending from the knee pad section for overlying an area between the knee pad section and the shin protector section.

According to another aspect of the invention there is provided an extensible shin guard comprising: a knee pad section, a shin protector section, a tongue member extending from the knee pad section and adapted to extend along an interior surface of the shin protector section, attachment means for releasably attaching said knee pad section to said shin protector section, spacing the knee pad section from the shin protector section at one of a plurality of positions for extending said shin guard, and a joint pad extending from the knee pad section for overlying an area between the knee pad section and the shin protector section.

According to another aspect of the invention, there is provided an extensible shin guard comprising: a knee pad section comprising a rigid cap member joined to a knee lining adapted to extend about the knee area of a wearer, a shin protector section comprising a rigid shin shell member joined to a shin lining adapted to extend about the calf area of the wearer, a tongue member extending from the knee pad section and adapted to extend along an interior surface of the rigid shin shell member, a pair of hook and loop fastener members for releasably attaching said tongue member to said shin protector section, spacing the knee pad section from the shin protector section at one of a plurality of positions for extending said shin guard, one of said hook and loop fastener members being mounted on said tongue member and the other of the hook and loop fastener members being mounted on an inside surface of the rigid shin shell member, a joint pad extending from the knee pad section for overlying an area between the knee pad section and the shin protector section, and a flexible pad extending from an inner and upper area of the knee pad section for frictionally fitting within said knee pad section and said shin protector section.

DESCRIPTION OF THE DRAWINGS

In drawings which illustrate the preferred embodiment of the invention.

DETAILED DESCRIPTION OF THE INVENTION

Figure 1:
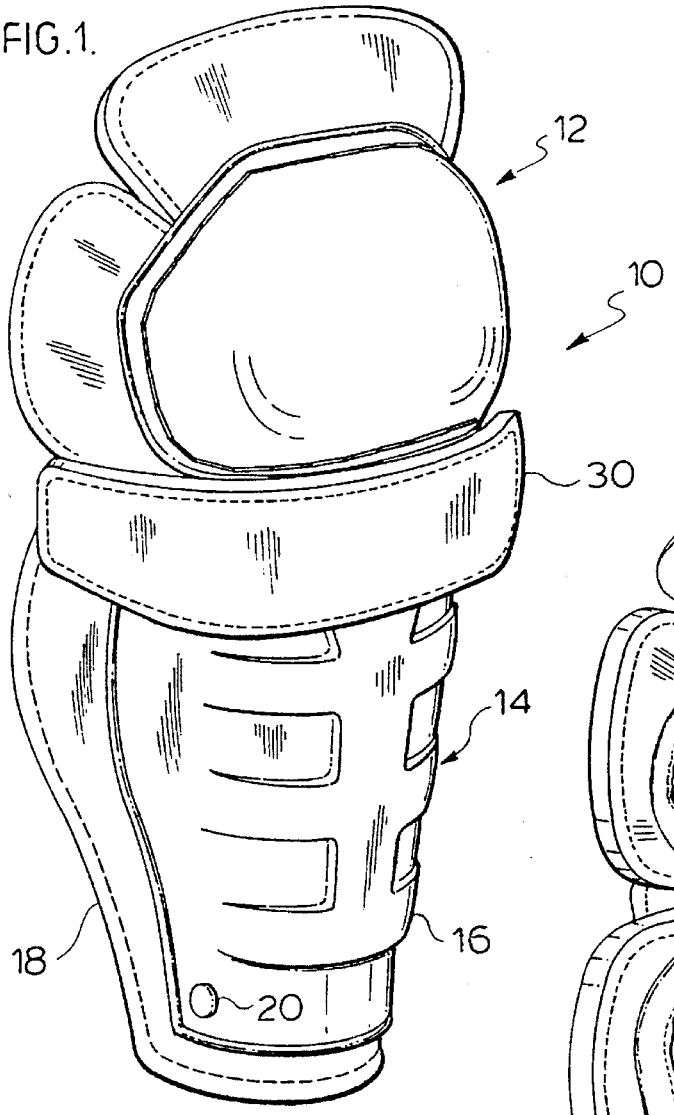
FIG. 1 is a perspective view of the outer side of the invention.
Figure 2:
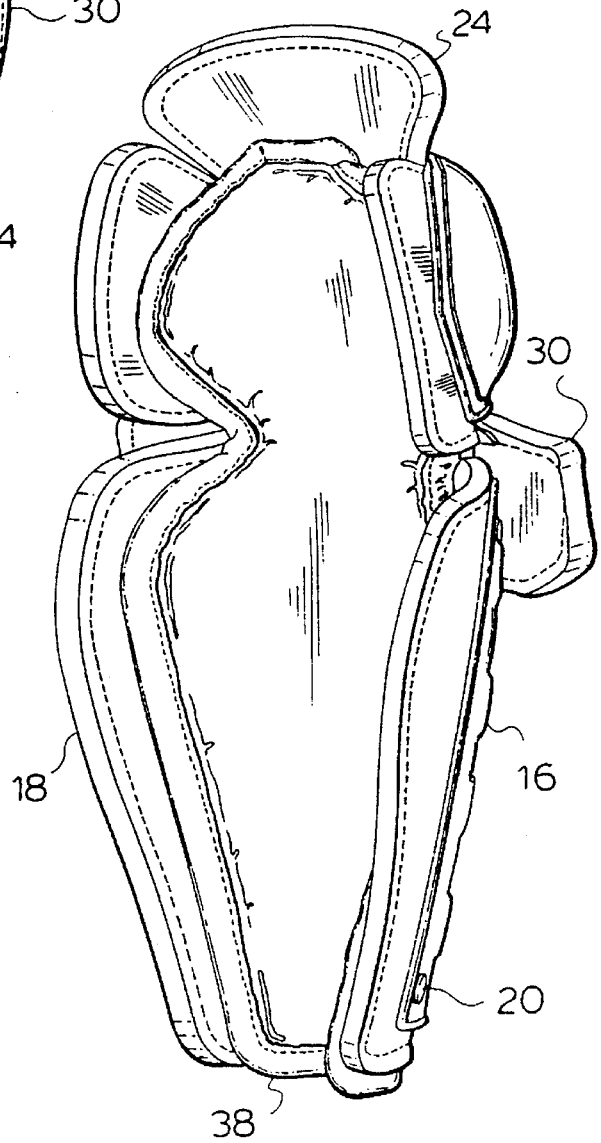
FIG. 2 is a perspective view of the inner side of the invention of FIG. 1.
Figure 3:
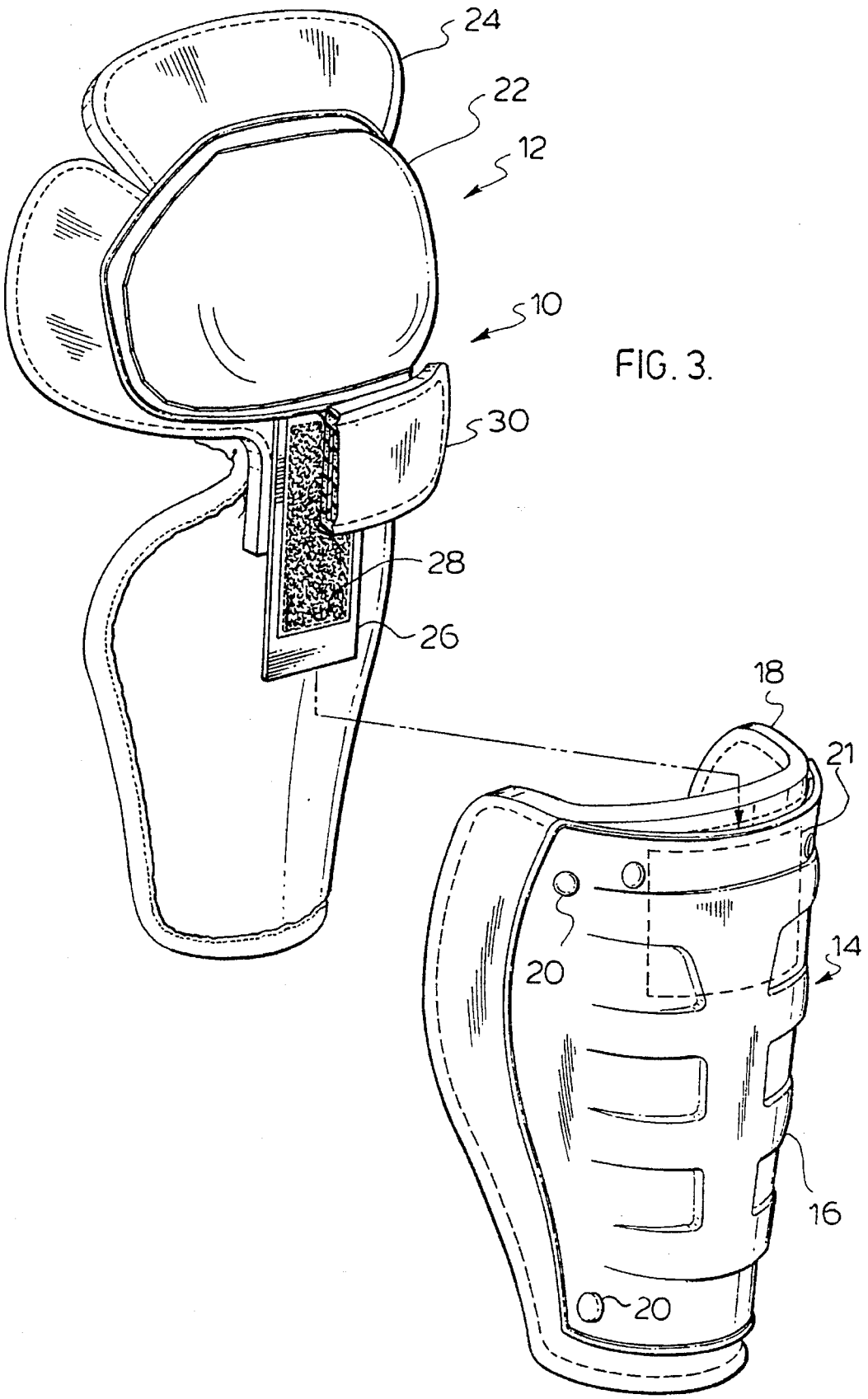
FIG. 3 is an exploded perspective view, partially in section, of the invention of FIG. 1.
Figure 4:
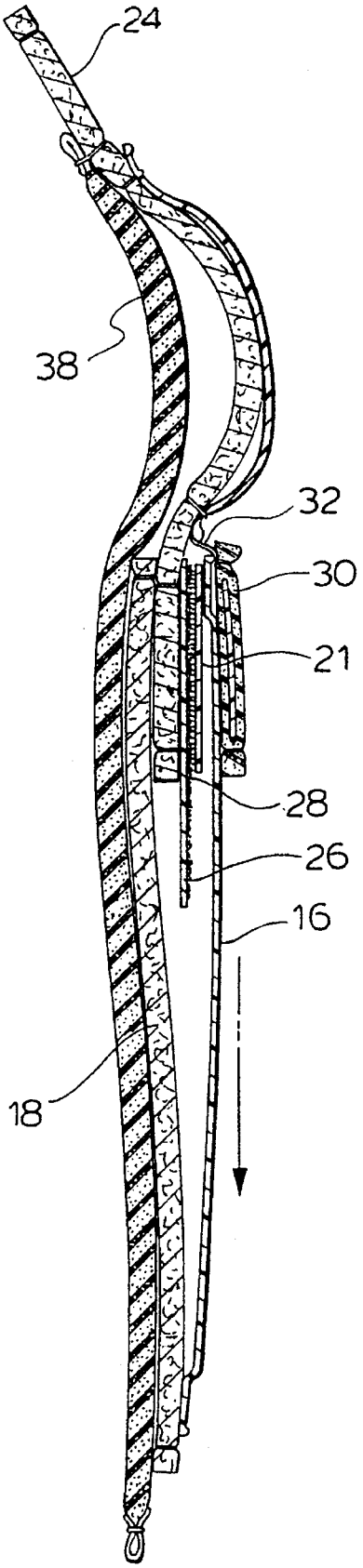
FIG. 4 is a sectional view of the invention of FIG. 1 with the shin guard in a reduced length.
Figure 5:
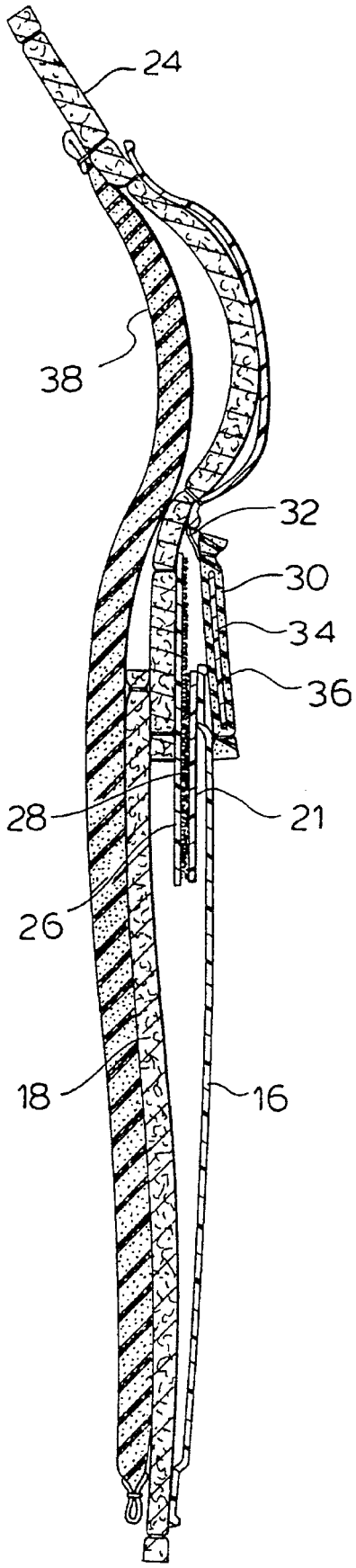
FIG. 5 is a section view of the invention of FIG. 1 with the shin guard in an extended length.

The shin guard of the present invention is generally illustrated as 10 in FIG. 1. The shin guard 10 has a knee pad section 12 and a shin protector section 14.

The shin protector section 14 has a rigid plastic shell 16 contoured to wrap around the front portion of the shin of the wearer. The plastic shell 16 has a flexible lining 18 attached across the inner surface thereof. The lining 18 is stretched and secured to the shell 16 by rivets 20 to define a space between the lining and the shell 16. Alternatively, lining 18 could be stitched to shell 16. The back side of member 21 of a hook and loop fastener is bonded to the inner surface of shell 16 at the upper end thereof.

The knee pad section 12 has a rigid plastic shell 22 which is contoured in a convex-concave cup shape. A flexible lining 24 extends outwardly from the shell 22. The lining 24 is stretched and stitched to the inner surface perimeter of the shell 22 to define a space between the lining 24 and the shell 22 to improve the protective capabilities of the knee pad section.

The lining 24 has a tongue member 26 extending from the lower end of the knee pad section 12. The tongue member 26 is preferably a flexible plastic material to provide the shin guard 10 some degree of flexibility between the knee pad section 12 and the shin protector section 14. The shin guard 10 is able to flex as the wearer bends at the knee. On the outer facing of the tongue member, the other member 28 of the pair of the hook and loop fastener is attached or sewn.

The knee pad section 12 has a joint pad 30 extending from the lower end thereof. The joint pad 30 is connected to a fabric material 32 which is sewn between the knee pad shell 22 and the lining 24. Joint pad 30 has a flexible plastic insert 34 which is enclosed by a fabric cover 36.

For added protection, the shin pad may be provided with a flexible pad member 38 which is connected to the upper end of the knee pad lining 24 and extends the length of the shin pad 10. The pad member 38 frictionally fits within the inner surface of the knee lining 24 and shin protector lining 18.

Linings 18 and 24 may be made from a felt material or a closed cell foam. In the preferred embodiment the closed cell foam material is encased in a fabric cover and has the edges trimmed with a fabric border to improve the aesthetic character of the shin guard.

In use, the tongue member 26 is inserted between the lining and shell of the shin pad section to engage the hook and loop fasteners 21 and 28. The hook and loop fasteners can be joined at any of a plurality of positions along the lengths thereof. Accordingly, the distance between the knee pad section 12 and the shin protector section 14 can be varied, extending the length of the shin guard 10 to custom fit any wearer.

The joint pad 30 hangs over the outer area between the knee pad section 12 and shin protector 14. The joint pad 30 will also provide protection to the wearer's lower knee cap area, an area which is particularly vulnerable.

Once the shin guard 10' has been sized to the wearer, the shin guard is worn about the calf area of the wearer with the knee pad section covering the knee cap area of the wearer. The combination of space between the lining and the rigid shell and the rigid shell itself provides protection for the wearer from sticks, skates and pucks.

It is now apparent to a person skilled in the art that the shin guard of the present invention could be dimensioned to fit different classes of wearers, i.e. adult and children's sizes. However, since many other modifications and purposes of this invention become readily apparent to those skilled in the art upon perusal of the foregoing description, it is to be understood that certain changes in style, size and components may be effective without a departure from the spirit of the invention and within the scope of the appended claims.

I claim:

1. An extensible shin guard comprising, a knee pad section comprising a rigid cap member joined to a knee lining for extending about the knee area of a wearer, a shin protector section comprising a rigid shin shell member joined to a shin lining for extending about the calf area of the wearer, said shin lining joined along opposite edges of said shell member presenting an opening between the shell member and the shin lining, a flexible plastic tongue member extending from the knee pad section and into said opening for engaging an interior surface of the rigid shin shell member, a pair of hook and loop fastener members for releasably attaching said tongue member to said shin protector section, spacing the knee pad section from the shin protector section at one of a plurality of positions for extending said shin guard in a custom fit, one member of said hook and loop fastener members being mounted on said tongue member and the other member of the hook and loop fastener members being mounted on an inside surface of the rigid shin shell member, a joint pad extending from the knee pad section for overlying an exterior surface of the shin protector section and covering a space between the knee pad section and the shin protector section as said shin guard is extended.

2. The extensible shin guard as claimed in claim 1 wherein said shin guard further comprises a flexible pad extending from an inner and upper area of the knee pad section for frictionally fitting within said knee pad section and said shin protector section.

3. The extensible shin guard as claimed in claim 1 wherein said knee lining and said shin lining are a closed cell foam material.

4. The extensible shin guard as claimed in claim 2 wherein said flexible pad is an open cell foam material.

5. The extensible shin guard as claimed in claim 1 wherein said knee lining and said shin linings are a felt material.

* * * * *